US008556295B2

(12) United States Patent
Johnson

(10) Patent No.: US 8,556,295 B2
(45) Date of Patent: Oct. 15, 2013

(54) SNOWBOARD ANCHORING SYSTEM AND METHOD

(76) Inventor: Avery C. Johnson, Denver, CO (US)

( * ) Notice: Subject to any disclaimer, the term of this patent is extended or adjusted under 35 U.S.C. 154(b) by 110 days.

(21) Appl. No.: 13/374,349

(22) Filed: Dec. 22, 2011

(65) Prior Publication Data

US 2013/0161934 A1 Jun. 27, 2013

(51) Int. Cl.
*A63C 11/00* (2006.01)

(52) U.S. Cl.
USPC ..... 280/809; 36/114; 36/115; 36/117.1; 36/122

(58) Field of Classification Search
USPC ..... 280/809, 604, 605, 14.22, 14.21, 816; 36/114, 115, 116, 117.1, 117.2, 122, 36/124
See application file for complete search history.

(56) References Cited

U.S. PATENT DOCUMENTS

| | | | | | |
|---|---|---|---|---|---|
| 2,246,153 | A * | 6/1941 | Wallace | 280/614 |
| 3,905,610 | A * | 9/1975 | Dini | 280/814 |
| 4,039,204 | A * | 8/1977 | Frey | 280/605 |
| 4,227,708 | A * | 10/1980 | Cote | 280/809 |
| 4,304,019 | A * | 12/1981 | Sava | 7/170 |
| 5,356,168 | A * | 10/1994 | Ozburn | 280/605 |
| 5,529,321 | A * | 6/1996 | Thompson | 280/19 |
| 5,769,444 | A * | 6/1998 | Mason | 280/600 |
| 5,816,602 | A | 10/1998 | Hayashi | |
| 6,247,253 | B1 * | 6/2001 | MacIntyre | 36/124 |
| 6,595,496 | B1 * | 7/2003 | Langlie et al. | 256/1 |
| 6,702,328 | B2 * | 3/2004 | Malleis et al. | 280/809 |
| 6,935,645 | B1 * | 8/2005 | Fuhrmeister | 280/87.042 |
| 7,010,823 | B2 * | 3/2006 | Baek | 12/142 P |
| 7,909,310 | B2 * | 3/2011 | Weiner | 256/45 |
| 2002/0175497 | A1 * | 11/2002 | Freemon | 280/605 |
| 2005/0173917 | A1 * | 8/2005 | Kovall et al. | 280/809 |
| 2006/0071449 | A1 * | 4/2006 | Backlund | 280/605 |
| 2006/0151504 | A1 * | 7/2006 | Garvie | 220/475 |
| 2006/0242862 | A1 * | 11/2006 | Chelani | 36/114 |
| 2007/0001089 | A1 * | 1/2007 | Moblo | 249/3 |
| 2007/0075524 | A1 * | 4/2007 | Kelly | 280/605 |
| 2007/0096432 | A1 * | 5/2007 | Wilson | 280/604 |
| 2009/0077833 | A1 * | 3/2009 | Kokavec | 36/134 |
| 2010/0044661 | A1 * | 2/2010 | Weiner | 256/1 |
| 2010/0175278 | A1 * | 7/2010 | Seliger | 36/117.1 |

* cited by examiner

*Primary Examiner* — Jeffrey J Restifo
*Assistant Examiner* — Erez Gurari
(74) *Attorney, Agent, or Firm* — Harold A. Burdick

(57) ABSTRACT

A snowboard system and methods are disclosed adapted for board stabilization while a user attaches the snowboard binding and boot from a standing position. The system includes an anchoring stake, a retainer and retractable cord, and an anchoring line, or loop. A safety retainer line from the stake may also be provided.

18 Claims, 8 Drawing Sheets

SNOWBOARD ANCHORING SYSTEM AND METHOD

FIELD OF THE INVENTION

This invention relates to snowboarding equipment, and, more particularly, relates to equipment and methods for restricting snowboard movement during boot to binding engagement.

BACKGROUND OF THE INVENTION

Snowboard binding/boot engagement must be undertaken many times per ski day for snowboarding enthusiasts, since most binding setups do not accommodate readily riding lifts or maneuvering lift lines with both bindings of the snowboard engaged to the rider's boots. Thus, one binding is typically released each time a rider reaches the bottom of the hill and wishes to board a lift for another run. Once the rider reaches the end of the lift and dismounts, the binding must be reengaged to start the run. Most snowboarders sit in the snow in order to insert their boot into the snowboard binding. This operation can be uncomfortable (cold, wet and awkward) and may be especially challenging for some when trying to get back on ones feet once the binding is attached, particularly for beginning or physically challenged boarders.

Therefore, for many it would be better if binding attachment could be undertaken from a standing or crouching position. However, applying the binding while standing presents a different set of challenges since the board is not easily stabilized on the snow during binding maneuvering, tending to slide, rotate or otherwise move while the rider is attempting binding application, thus making balance difficult and the process nearly impossible.

Various devices to brake a board selectively to stop board sliding have been suggested heretofore (see U.S. Pat. Nos. 5,816,602 and 5,356,168, and U.S. patent publication number 2007/0096432, for example). Such devices have, however, required permanent installations on the snowboard and are often overly large, intrusive, complicated, and unsightly. Other braking or retention devices to avoid board runaway have heretofore been suggested and/or utilized (see U.S. Pat. Nos. 4,227,708 and 6,702,328, and U.S. patent publication numbers 2007/0075524, 2002/0175497, and 2005/0173917). But these devices have likewise required permanent board installations in some cases and/or have not actually stabilize board sliding (only maintaining board association with the rider).

As may be appreciated therefor, improved means for board stabilization allowing binding attachment while standing could thus be utilized.

SUMMARY OF THE INVENTION

This invention provides a snowboard anchoring system adapted for stabilizing a snowboard while a user attaches his/her footwear at the snowboard's binding, preferably from a standing position. The system of this invention includes an anchoring stake not associated with the snowboard but readily manipulable by the user. An anchoring line is securable at one of the footwear and the binding for selective engagement with the stake when snowboard stabilization is desired. A retainer, preferably having a housing with a clip thereat for securing the housing to the footwear, includes a retractable cord attachable to the stake. The cord is maintained in the housing and is selectively extendable therefrom and retractable thereinto by a user, the cord attachable to a stake attachment ring.

The anchoring line preferably includes first and second loops, the first loop securable at one of the footwear and the binding and the second loop engagable by the stake when the snowboard is to be stabilized against undesired sliding. A safety line may be provided, attachable at one end with the footwear and at its opposite end to the anchoring stake attachment ring.

The snowboard anchoring method of this invention is adapted for selective stabilization of a snowboard while a user is standing thereupon. The method includes the steps of securing a line at one of a snowboarder's footwear and a binding attached to the snowboard, and retractably retaining a stake in association with the user. A user selectively engages the stake with the line when snowboard stabilization is desired and retracts the stake toward the user's body when not in use.

It is therefore an object of this invention to provide an improved snowboard anchoring system and methods for stabilizing a snowboard and rider in the standing position.

It is another object of this invention to provide a snowboard anchoring system and methods adapted for board stabilization while a user attaches the snowboard binding and boot from a standing position.

It is still another object of this invention to provide a snowboard anchoring system and methods wherein no installations on the snowboard are required.

It is yet another object of this invention to provide snowboard anchoring systems and methods that are simple to use, relatively small in size and unobtrusive when not in use.

It is still another object of this invention to provide a snowboard anchoring system adapted for stabilizing a snowboard while a user attaches a user footwear at a snowboard binding affixed to the snowboard, the system including an anchoring stake not associated with the snowboard and readily manipulable by the user, and an anchoring line securable at one of the footwear and the binding for selective engagement with the stake when snowboard stabilization is desired.

It is yet another object of this invention to provide a snowboard anchoring system adapted for stabilizing a snowboard while a user attaches a user footwear at a snowboard binding affixed to the snowboard, the system including an anchoring stake not associated with the snowboard and having an attachment thereat, a retainer having a housing with a clip thereat for securing the housing to the footwear, a retractable cord maintained in the housing and selectively extendable therefrom and retractable thereinto by a user, the cord attachable at the stake attachment, an anchoring line including first and second loops, the first loop securable at one of the footwear and the binding and the second loop for selective engagement by the stake when snowboard stabilization is desired, and a safety line attachable at one end with the footwear and attachable at an opposite end to the anchoring stake attachment.

It is another object of this invention to provide a snowboard anchoring method for selective stabilization of a snowboard while a user is standing thereupon that includes the steps of securing a line at one of a snowboarder's footwear and a binding attached to the snowboard, retractably retaining a stake in association with the user, selectively engaging the stake with the line when snowboard stabilization is desired, and retracting the stake toward the user's body when not in use for snowboard stabilization.

With these and other objects in view, which will become apparent to one skilled in the art as the description proceeds, this invention resides in the novel construction, combination, and arrangement of parts and methods substantially as hereinafter described, and more particularly defined by the appended claims, it being understood that changes in the precise embodiment of the herein disclosed invention are meant to be included as come within the scope of the claims.

BRIEF DESCRIPTION OF THE DRAWINGS

The accompanying drawings illustrate a complete embodiment of the invention according to the best mode so far devised for the practical application of the principles thereof, and in which.

DESCRIPTION OF THE INVENTION

Figure 1:
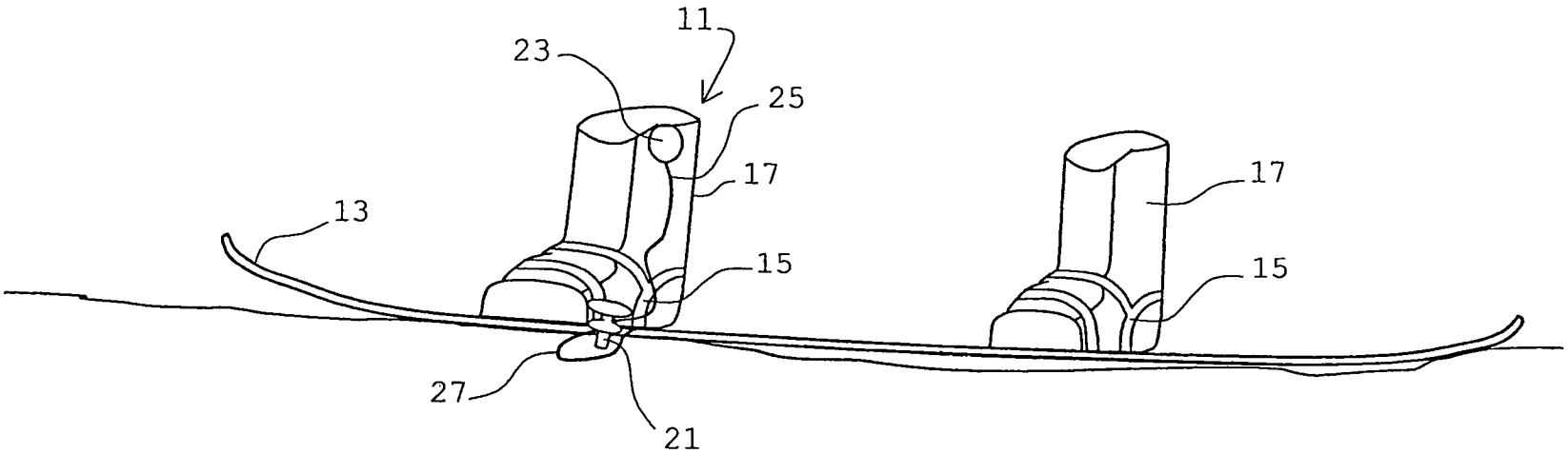
FIG. 1 is an illustration of the snowboard anchoring system of this invention.
Figure 2:
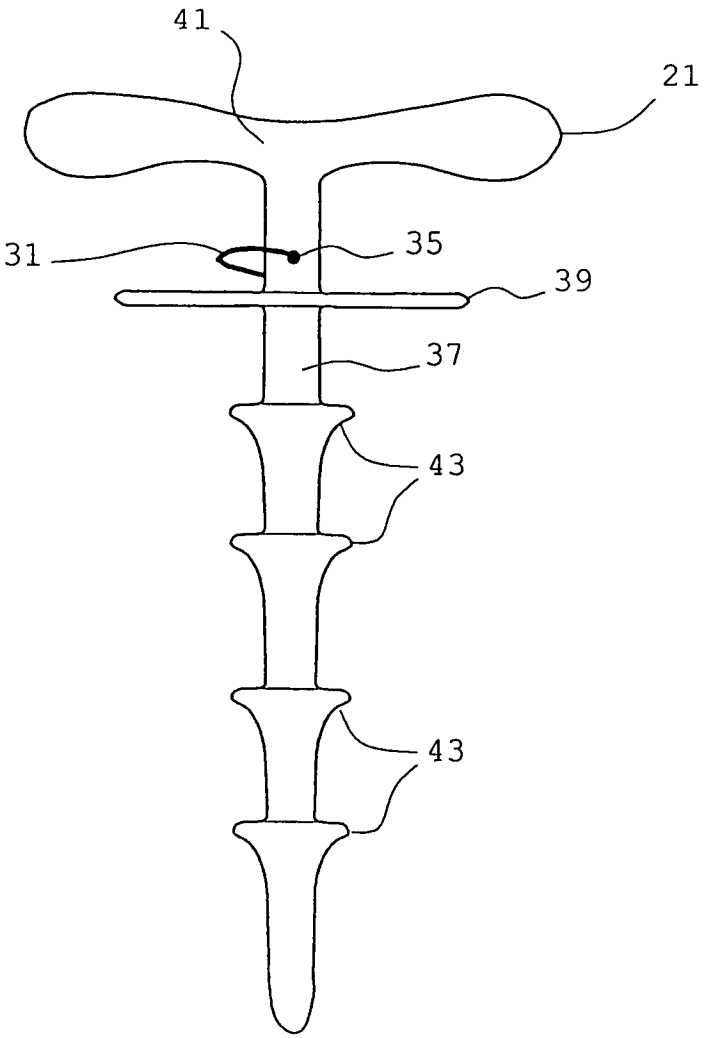
FIG. 2 is a side view of the anchoring stake used with this invention.
Figure 3:
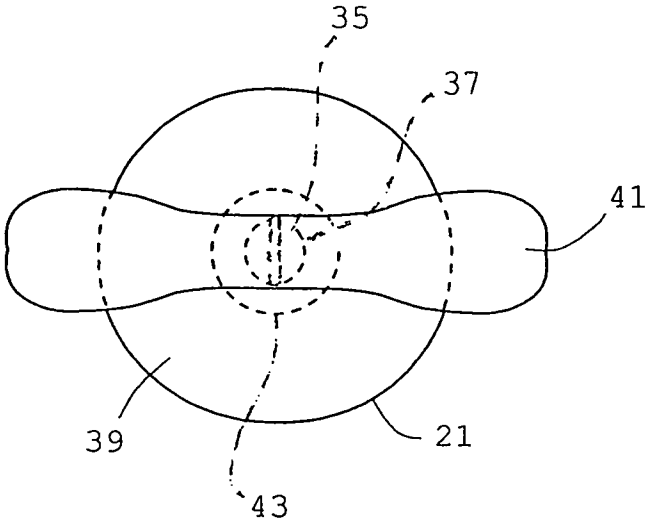
FIG. 3 is a top view of the anchoring stake shown in FIG. 2.
Figure 4:
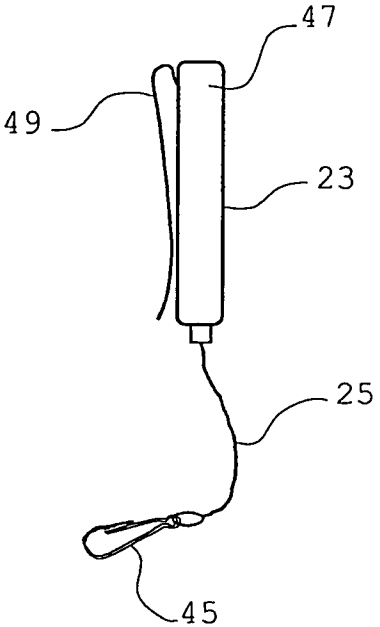
FIG. 4 is a side view of the anchoring stake retracting retainer used with this invention.
Figure 5:
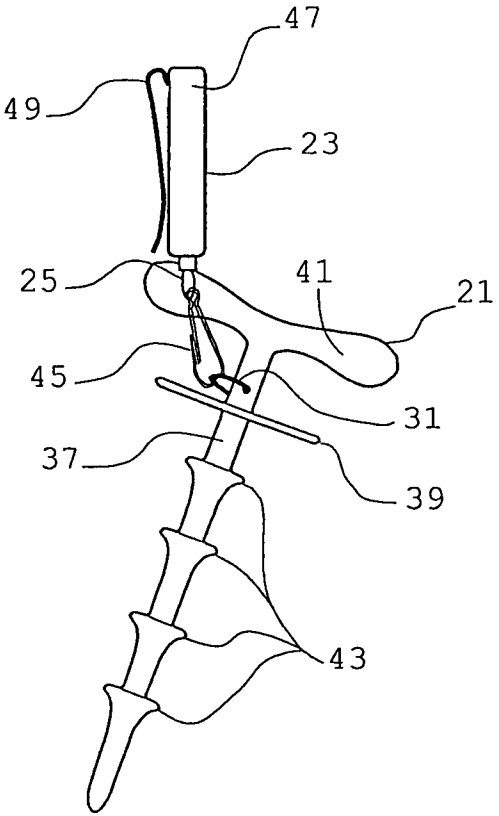
FIG. 5 is a side view of the retracting retainer associated with the anchoring stake.

System 11 of this invention is illustrated in FIG. 1 in association with snowboard 13 having bindings 15 mounted thereon for receipt of snowboarder footwear (boots typically) 17. System 11 includes anchoring stake 21, retainer 23 having retractable cord 25 extendable therefrom, and anchoring line, or loop, 27. Safety line 29 may be provided, and when present extends between stake attachment 31 (tied on for example) at one end and retaining clip 33 at its opposite to prevent loss of stake 21 (see FIGS. 2, 5, 7 and 8).

As shown in FIGS. 2, 3, 7 and 8, anchoring stake 21 is not associated (attached) with snowboard 13 but is held readily manipulable by the user. It can be made of any lightweight, durable material (plastic, wood or the like). Attachment 31 (preferably a ring) is retained though passage 35 at shaft 37 above snow packer shelf 39. Handle 41 is provided at the top of shaft 37 for user manipulation of stake 21 in the snow and withdrawal therefrom, and retainer segments 43 are formed along shaft 37 to better assure stake 21 retention once implanted in the snow. The stake shaft 37 has a dull point to avoid any injury.

Figure 7:
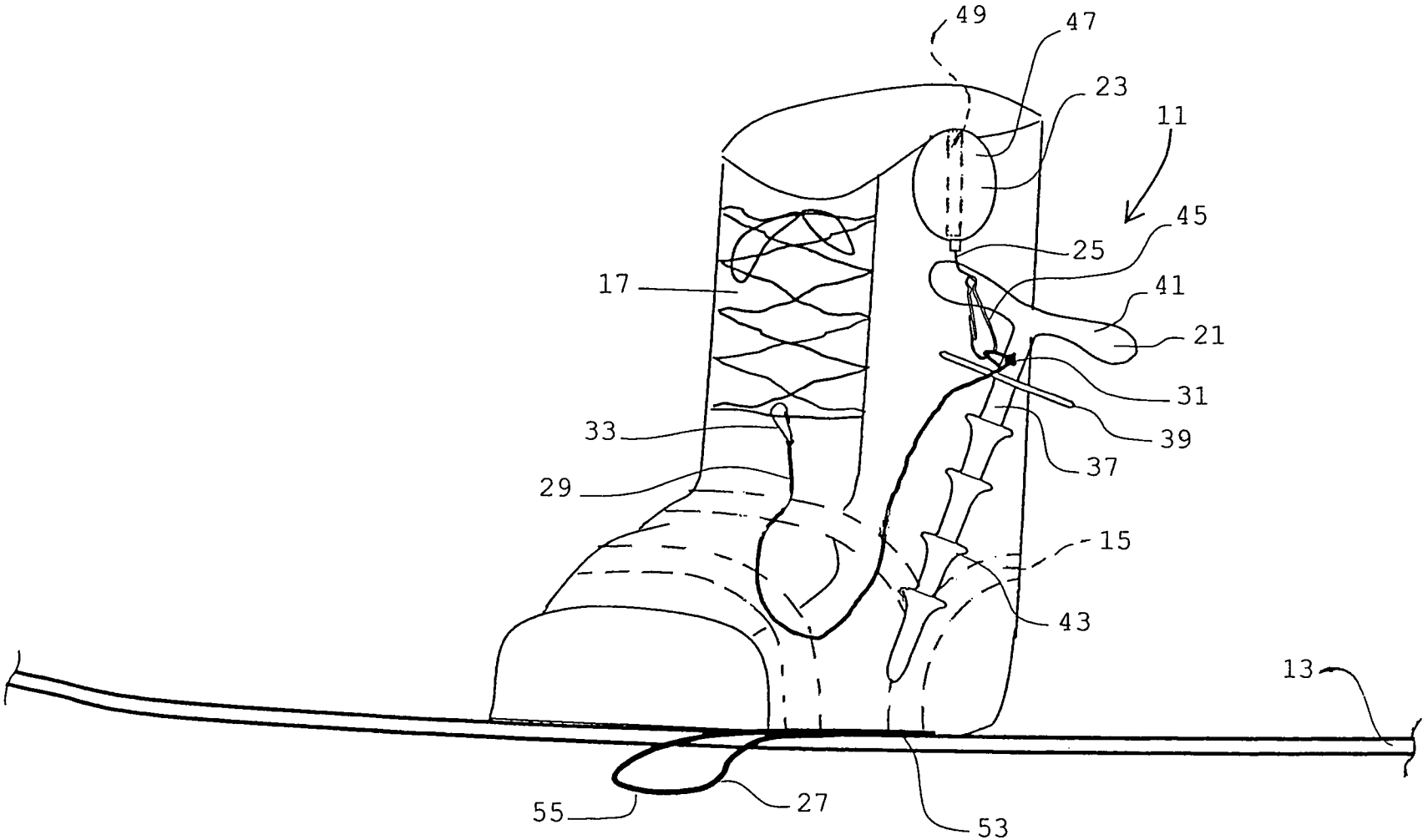
FIG. 7 is an illustration of the system of this invention in use in the stored position.
Figure 8:
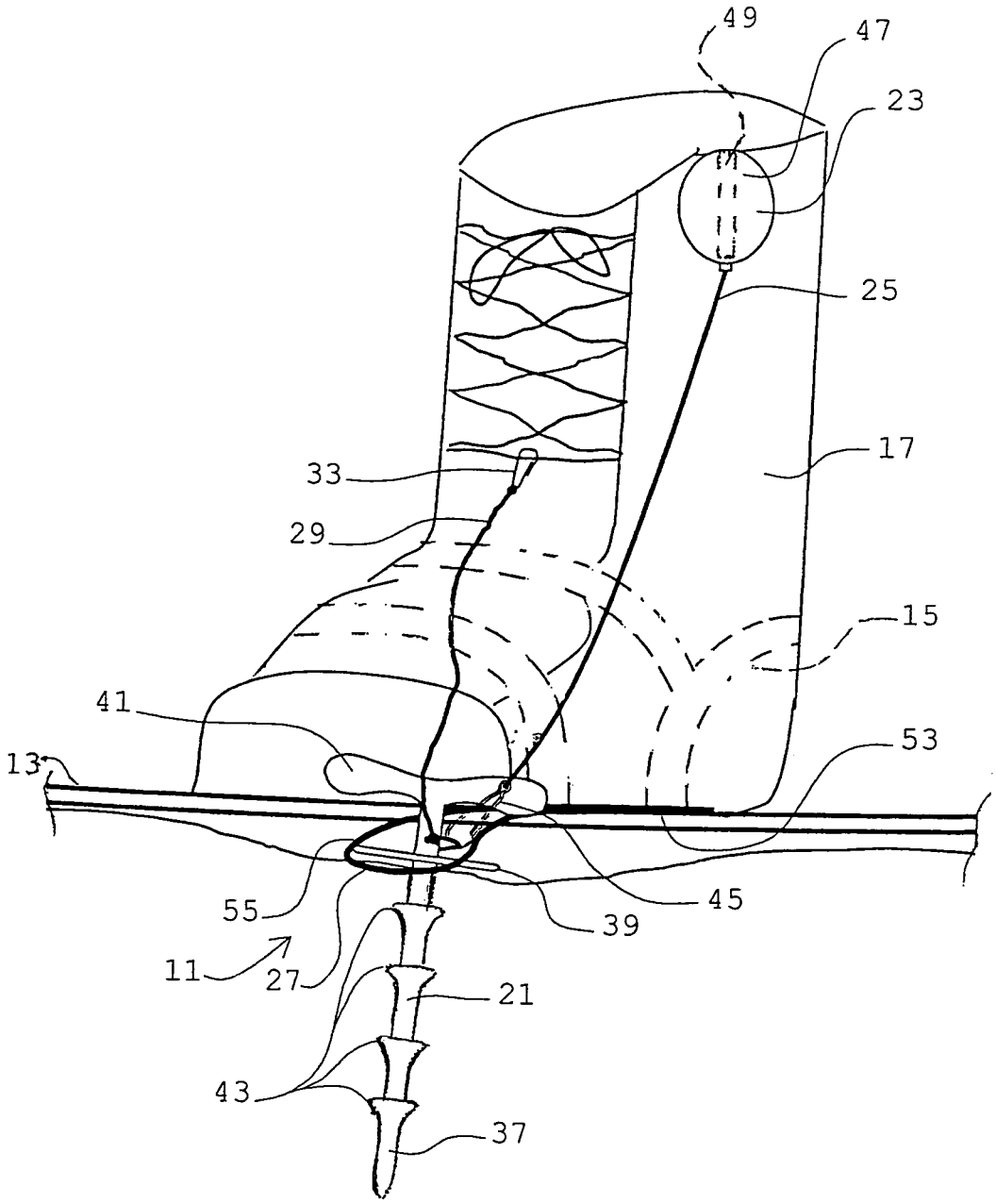
FIG. 8 is an illustration of the system of this invention in use anchoring a snowboard.

Retainer 23, as more fully illustrated in FIGS. 4, 5, 7 and 8, includes clip 45 attached (tied, for example) to one end of cord 25 extending from housing 47 of retainer 23. Clip 45 is thus attachable to stake. 21 Clip 49 affixed at the rear of housing 47 accommodates releasable securement of housing 47 to footwear 17. Cord 25 is selectively extendable from and retractable into housing 47 by a user, utilizing any such retraction mechanisms common and heretofore known (used, for example, for key ring mechanisms, tape measure mechanisms, and the like). In this way, as shown in FIGS. 7 and 8, stake 21 is readily extendable away from the user's body when stabilization of the board is desired but retractable to a position adjacent the boot and out of the way when not in use.

Figure 6:
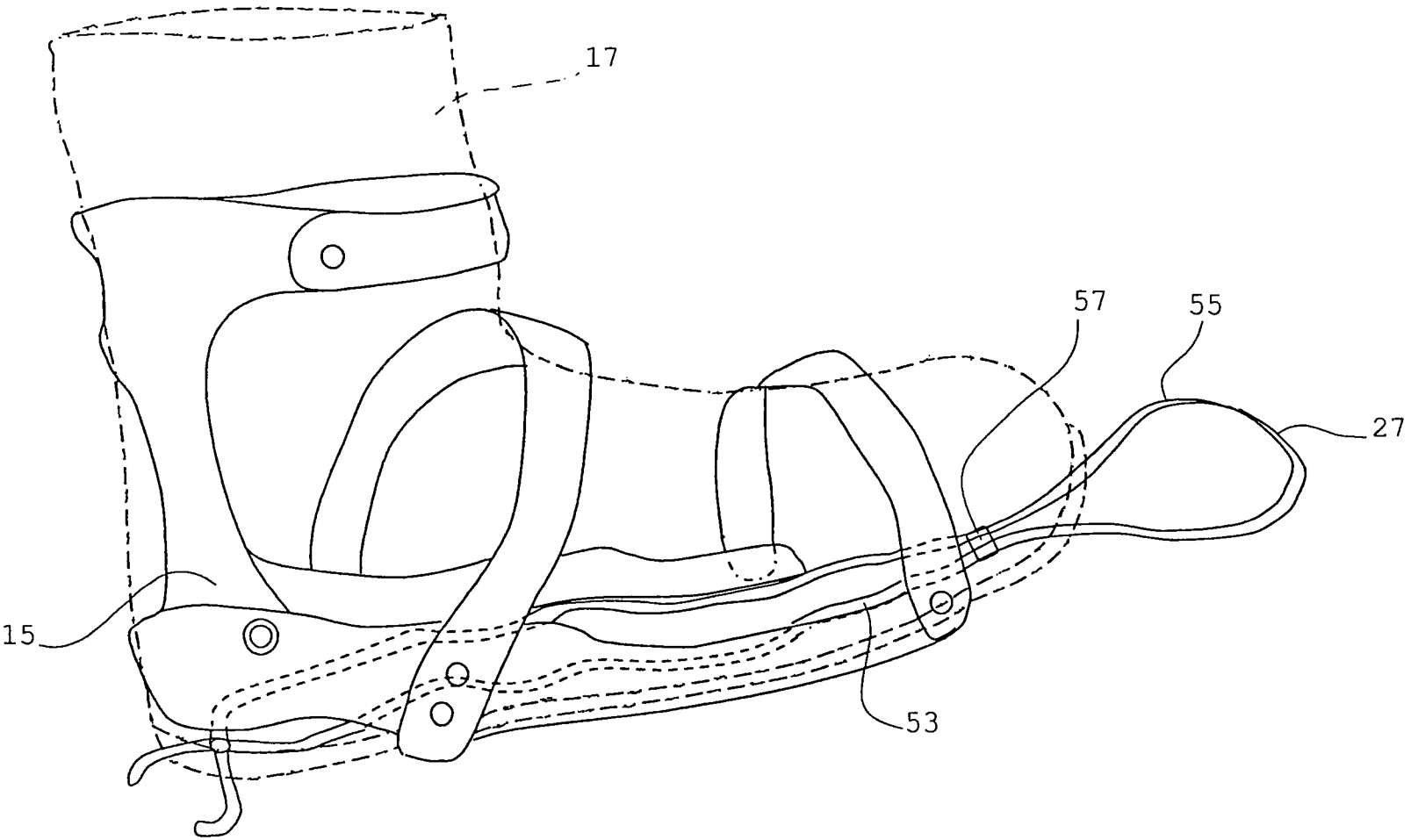
FIG. 6 is a perspective view of a boot and binding interface having the anchoring line used with this invention associated therewith.

As shown in FIGS. 6, 7 and 8, anchoring line 27 preferably includes first and second loops 53 and 55, loop 53 securable at either footwear 17 or binding 15. Loops 53 and 55 may be formed by a single, endless strand of durable cable or cord tied or otherwise secured at its ends and cleated (using cleat 57, for example) or tied at an intermediate juncture to form the two loops. Loop 55 thus extends away from binding 15, footwear 17 and board 13, readily accessible for selective engagement by stake 21 when snowboard stabilization is desired but capable of being tucked away when not in use. Different arrangements of line 27 can of course be utilized (for example, providing no loops at all, relying instead on cord wrapping or tying, using a single loop, using a single loop and twisting the loop at a selected juncture, using a cord with rings or clips at its ends, or the like as may be readily conceivable).

Safety line 29 when provided is attached at clip 33 to footwear 17. In use to selectively stabilize snowboard 13 while a user is standing thereupon, a boarder may or may not have one (often the rear) binding 15 already secured to boot 17. When ready to secure the footwear to the bindings (or the other boot 17 to its binding 15), stake 21 is grasped by handle 41 to extend cord 25 from housing 47 of retainer 23, and shaft 37 is positioned in the snow and through loop 55 of anchoring line 27. If line 27 is not already attached to binding 15 at loop 53 (preferred), loop 53 may be secured to boot 17 or between boot 17 and binding 15. Once stake 21 is firmly implanted in the snow and has engaged loop 55, a user may proceed with attaching the binding and the boot while standing, movement of the board, and thus imbalance of the user during the operation, being inhibited by the stake 21 line 27 interface. Once the boot is secured in the binding, handle 41 is again grasped to withdraw stake 21 from the snow, cord 25 and stake 21 being retracted by the automatic mechanism of housing 47 of retainer 23 to a position adjacent boot 17.

As may be appreciated from the foregoing, this invention stabilizes a snowboard promoting user balance for operations on the snowboard when not in motion. The system is small lightweight and unobtrusive. No installations are required on the snowboard itself, and no permanent installations are required on any other of the boarder's equipment.

What is claimed is:

1. A snowboard anchoring system adapted for stabilizing a snowboard while a user attaches a user footwear at a snowboard binding affixed to the snowboard, said system comprising:

an anchoring stake not associated with the snowboard and readily manipulable by the user;

wherein said stake includes a snow packer shelf and a shaft with retainer segments therealong;

and an anchoring line securable at one of the footwear and the binding for selective engagement with said stake when snowboard stabilization is desired.

2. The system of claim 1 further comprising a safety line having a clip at one end for association with the footwear and attachable at an opposite end to said anchoring stake.

3. The system of claim 1 further comprising a retainer having a retractable cord extendable therefrom, said cord attachable to said stake.

4. The system of claim 1 wherein said anchoring stake includes a handle.

5. The system of claim 1 wherein said anchoring line includes a single strand of durable cord secured at its ends.

6. A snowboard anchoring system adapted for stabilizing a snowboard while a user attaches a user footwear at a snowboard binding affixed to the snowboard, said system comprising:

an anchoring stake not associated with the snowboard and having an attachment thereat;

a retainer having a housing securable adjacent to the footwear, a retractable cord maintained in said housing and selectively extendable therefrom and retractable thereinto by a user, said cord attachable at said stake attachment;

an anchoring line including first and second loops, said first loop securable at one of the footwear and the binding and said second loop for selective engagement by said stake when snowboard stabilization is desired; and a safety line attachable at one end with the footwear and attachable at an opposite end to said anchoring stake attachment.

7. The system of claim 6 wherein said attachment at said anchoring stake is a ring affixed to said stake.

8. The system of claim 6 wherein said housing of said retainer includes a footwear mounting clip.

9. The system of claim 6 wherein said stake includes a snow packer shelf and retainer segments below said shelf to better assure stake retention once implanted in snow.

10. The system of claim 6 wherein said first loop of said anchoring line is securable at the binding and said second loop is freely manipulable to positions spaced from the binding.

11. The system of claim 6 wherein said safety line and said cord both include clips releasably engagable at said stake attachment.

12. The system of claim 6 wherein loops of said anchoring line are formed by intermediate securement of an endless strand.

13. A snowboard anchoring method for selective stabilization of a snowboard while a user is standing thereupon comprising the steps of:

securing a line at one of a snowboarder's footwear and a binding attached to the snowboard;

retractably retaining a stake in association with the user;

selectively engaging the stake with the line when snowboard stabilization is desired; and retracting the stake toward the user's body when not in use for snowboard stabilization.

14. The method of claim 13 further comprising the step of attaching the binding and the footwear while the stake and the line are engaged.

15. The method of claim 13 wherein the steps of retractably retaining a stake, selectively engaging the stake and retracting the stake include the steps of connecting the stake to a cord, and extending and automatically retracting the cord.

16. The method of claim 15 wherein the step of extending and automatically retracting the cord includes extending and retracting the cord from a housing at the footwear.

17. The method of claim 13 wherein the step of selectively engaging the stake with the line includes the step of forming a loop in the line and positioning the stake in the loop.

18. The method of claim 13 wherein the step of engaging the stake with the line includes user manipulation of the stake to implant it in snow adjacent to the snowboard and engaging the line.

* * * * *